US007536993B2

(12) United States Patent
Tsukiji et al.

(10) Patent No.: US 7,536,993 B2
(45) Date of Patent: May 26, 2009

(54) THROTTLE DEVICES FOR INTERNAL COMBUSTION ENGINES

(75) Inventors: Kiyoshi Tsukiji, Aichi-ken (JP); Hiroyasu Kariya, Kariya (JP); Yoshiki Ito, Nagoya (JP)

(73) Assignee: Aisan Kogyo Kabushiki Kaisha, Obu-shi, Aichi-ken (JP)

( * ) Notice: Subject to any disclaimer, the term of this patent is extended or adjusted under 35 U.S.C. 154(b) by 11 days.

(21) Appl. No.: 12/052,921

(22) Filed: Mar. 21, 2008

(65) Prior Publication Data

US 2008/0236541 A1 Oct. 2, 2008

(30) Foreign Application Priority Data

Mar. 27, 2007 (JP) ..... 2007-081287

(51) Int. Cl.
*F02D 9/10* (2006.01)

(52) U.S. Cl. ..... 123/399; 123/361

(58) Field of Classification Search ..... 123/361, 123/399

See application file for complete search history.

(56) References Cited

U.S. PATENT DOCUMENTS 6,240,899 B1 * 6/2001 Yamada et al. ..... 123/396
6,286,481 B1 * 9/2001 Bos et al. ..... 123/399
6,390,062 B1 * 5/2002 Saito et al. ..... 123/399
6,912,994 B2 * 7/2005 Ozeki et al. ..... 123/399
6,997,438 B2 * 2/2006 Fauni ..... 251/305
7,028,979 B2 * 4/2006 Fauni ..... 251/129.12
7,055,498 B2 * 6/2006 Hashimoto et al. ..... 123/361
7,275,557 B2 * 10/2007 Piciotti et al. ..... 137/15.25
2005/0126536 A1 * 6/2005 Torii et al. ..... 123/399
2007/0056559 A1 * 3/2007 Kondo ..... 123/399

FOREIGN PATENT DOCUMENTS

JP 2000-110589 A 4/2000

* cited by examiner

*Primary Examiner*—Erick Solis
(74) *Attorney, Agent, or Firm*—Dennison, Schultz & MacDonald

(57) ABSTRACT

A throttle device for an internal combustion engine includes a throttle body, a transmission mechanism and an opener. A relief spring is interleaved between the throttle body and the opener. A back spring is interleaved between a final stage gear of the transmission mechanism and the opener. Each of the relief spring and the back spring is formed of a torsion coil spring. One or each of the terminal ends of the relief spring or the back spring is bent in a radial direction with respect to an axis of a coil portion. The opener or the final stage gear has at least one spring support portion with an engaging recess. The engaging recess is configured to permit insertion of the radially bent terminal end and to permit movement of the radially bent terminal end relative to the engaging recess in a circumferential direction with respect to an axis of the coil portion. The engaging recess is engageable with the radially bent terminal end as the radially bent terminal end moves in the circumferential direction relative to the engaging recess.

17 Claims, 11 Drawing Sheets

THROTTLE DEVICES FOR INTERNAL COMBUSTION ENGINES

This application claims priority to Japanese patent application serial numbers 2007-081287, the contents of which are incorporated herein by reference.

BACKGROUND OF THE INVENTION

1. Field of the Invention

The present invention relates to throttle devices for internal combustion engines, and in particular to throttle devices having electrically-driven actuators that are actuated to open and close throttle valves for controlling the flow of intake air to be supplied to internal combustion engines.

2. Description of the Related Art

Throttle devices are known that include electrically-driven actuators, such as DC motors and stepping motors, which are actuated to open and close throttle valves. This type of throttle device is disclosed, for example, in Japanese Laid-Open Patent Publication No. 2000-110589. According to this publication, a throttle valve is held at an opener opening angle that is larger than an opening angle at a fully closed position of the throttle valve when no power is supplied to an electrically-driven actuator. The term "opener opening angle" is used to mean an open angle set by an opener.

The throttle device of the above publication will be described with reference to FIGS. 15 and 16. As shown in FIG. 15, a throttle gear 143 is mounted to a throttle shaft 103 of a throttle valve 10 that can be rotated to open and close an intake air channel 101 defined within a throttle body 100. An engaging lever 106 is loosely fitted about the throttle shaft 103, so that the engaging lever 106 can rotate about the throttle shaft 103. The throttle gear 143 is a final stage gear of a gear mechanism for transmitting rotation of a motor 105 to the throttle shaft 103. A default spring 108 is a torsion coil spring and is interleaved between the throttle gear 143 and the engaging lever 106. The default spring 108 serves to resiliently keep engagement between an engaging edge 143*a* of the throttle gear 143 and an arm portion 162 of the engaging lever 106. A return spring 107 is a torsion coil spring and is interleaved between the throttle body 100 and the engaging lever 106. The return spring 107 serves to bias the engaging lever 106 in a closing direction. An engaging portion 161 of the engaging lever 106 can contact a stopper 111 that is mounted to the throttle body 100 for setting a default open angle, so that the engaging lever 106 can be prevented from rotating to result an open angle that is smaller than the opener open angle. Therefore, when no power is supplied to the motor 105, the engaging lever 106 contacts the stopper 111 by the biasing force of the return spring 107, while the throttle gear 153 and the engaging lever 106 engage with each other by the biasing force of the default spring 108. As a result, the throttle valve 102 can be held at the opener opening angle. The engaging lever 106, the return spring 107, the default spring 108, the stopper 111 and the throttle gear 143 constitute a default open angle setting mechanism.

In the above throttle device, in order to mount the default spring 108 to the engaging lever 106, a hook 108*b* is formed on the default spring 108 by bending a terminal end of the default spring 108 outwardly in a turn back manner. The hook 108*b* engages a spring engaging portion 164 of the engaging lever 106. The spring engaging portion 164 has a configuration like a pin. This mounting structure has a problem that the operation for engaging the hook 108*b* with the spring engaging portion 164 cannot be easily performed. In addition, a possibility may exist that the hook 108*b* is accidentally removed from the spring engaging portion 164.

Therefore, there has been a need for throttle devices that can facilitate the mounting operation of a torsion coil spring to a spring mount and can prevent or inhibit the torsion spring from being removed from the spring mount.

SUMMARY OF THE INVENTION

One aspect according to the present invention includes a throttle device for an internal combustion engine. The throttle device includes a throttle body, a transmission mechanism and an opener. A relief spring is interleaved between the throttle body and the opener. A back spring is interleaved between a final stage gear of the transmission mechanism and the opener. Each of the relief spring and the back spring is formed of a torsion coil spring. One or each of the terminal ends of the relief spring or the back spring is bent in a radial direction with respect to an axis of a coil portion. The opener or the final stage gear has at least one spring support portion with an engaging recess. The engaging recess is configured to permit insertion of the radially bent terminal end and to permit movement of the radially bent terminal end relative to the engaging recess in a circumferential direction with respect to the axis of the coil portion. The engaging recess is engageable with the radially bent terminal end as the radially bent terminal end moves in the circumferential direction relative to the engaging recess.

DETAILED DESCRIPTION OF THE INVENTION

Figure 1:
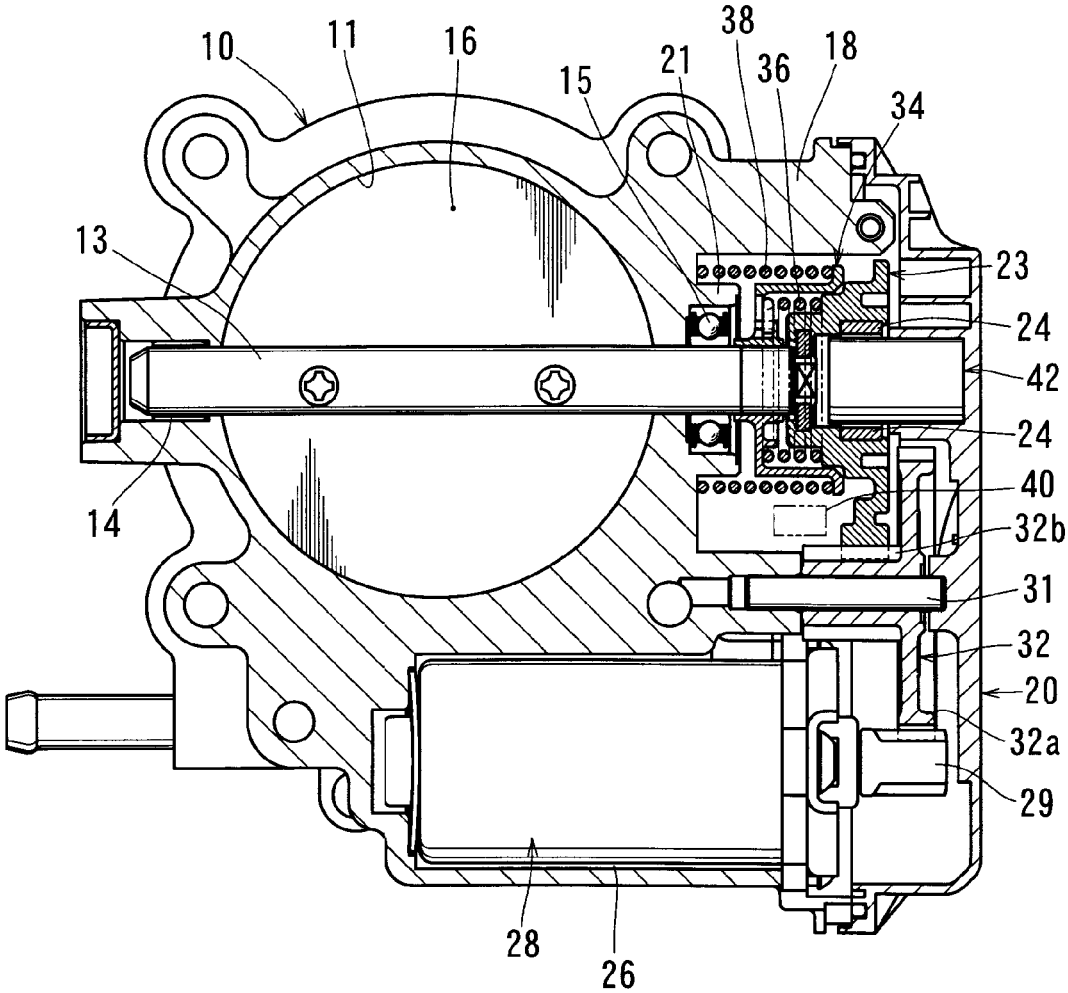
FIG. 1 is a vertical sectional view of a throttle device for an internal combustion engine according to a first embodiment of the present invention.
Figure 2:
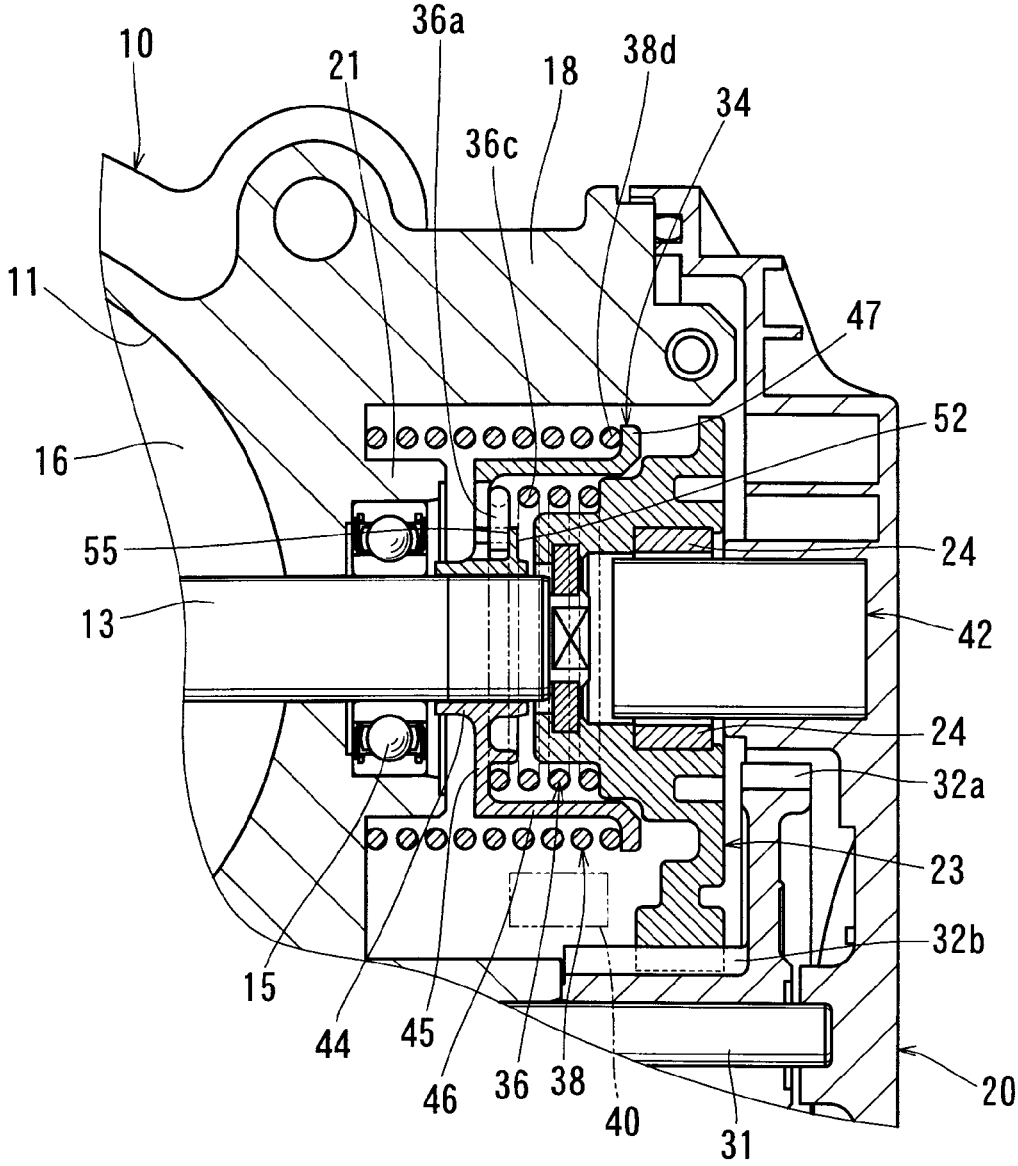
FIG. 2 is an enlarged view of the primary construction of the throttle device shown in FIG. 1.

Each of the additional features and teachings disclosed above and below may be utilized separately or in conjunction with other features and teachings to provide improved throttle devices. Representative examples of the present invention, which examples utilize many of these additional features and teachings both separately and in conjunction with one another, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful embodiments of the present teachings.

In one embodiment, a throttle device for an internal combustion engine includes a throttle body defining therein an intake air channel, a throttle valve having a throttle shaft and disposed within the intake air channel, an electrically-driven actuator operable to rotate the throttle shaft for opening and closing the throttle valve, and a gear transmission mechanism constructed to transmit a drive force of the actuator to the throttle shaft. The gear transmission mechanism includes a final stage gear, such as a throttle gear, fixedly mounted to the throttle shaft. An opener is rotatably mounted to the throttle shaft. A back spring is a torsion coil spring and is interleaved between the throttle body and the opener, so that the opener is biased in a closing direction of the throttle valve by the back spring. An opener open-angle setting stopper is disposed on the throttle body. The stopper serves to prevent the opener from rotating to such an open angle that is smaller than an opener open angle. The opener open angle is larger than an open angle of the throttle valve at a fully closed position of the throttle valve. A relief spring is a torsion coil spring and is interleaved between the final stage gear and the opener, so that (a) the final stage gear and the opener engage with each other and rotate together when the open angle of the throttle valve is equal to or larger than the opener open angle, and (b) the final stage gear can rotate in a direction for disengagement with the opener when the open angle of the throttle valve is smaller than the opener open angle. The throttle valve is held at the opener open angle when no power is supplied to the actuator.

In one arrangement, the relief spring has a terminal end on the side of the opener. The terminal end is bent radialy outward or inward of a coil portion of the relief spring. The opener has an engaging recess that can receive the radially bent terminal end. The engaging recess is configured to permit movement of the radially bent terminal end in a circumferential direction of the opener and to be able to engage the radially bent terminal end at a predetermined position with respect to the circumferential direction.

With this arrangement, it is possible to facilitate the mounting operation of the terminal end of the relief spring (torsion coil spring) to the opener, while it is possible to prevent or inhibit the accidental removal of the terminal end from the opener.

In another arrangement, the back spring has a terminal end on the side of the opener. The terminal end is bent radialy outward or inward of a coil portion of the back spring. The opener has an engaging recess that can receive the radially bent terminal end. The engaging recess is configured to permit movement of the radially bent terminal end in a circumferential direction of the opener and to be able to engage the radially bent terminal end at a predetermined position with respect to the circumferential direction.

With this arrangement, it is possible to facilitate the mounting operation of the terminal end of the back spring (torsion coil spring) to the opener, while it is possible to prevent or inhibit the accidental removal of the terminal end from the opener.

In a further arrangement, the relief spring has a terminal end on the side of the final stage gear. The terminal end is bent radialy outward or inward of a coil portion of the relief spring. The final stage gear has an engaging recess that can receive the radially bent terminal end. The engaging recess is configured to permit movement of the radially bent terminal end in a circumferential direction of the final stage gear and to be able to engage the radially bent terminal end at a predetermined position with respect to the circumferential direction.

With this arrangement, it is possible to facilitate the mounting operation of the terminal end of the relief spring (torsion coil spring) to the final stage gear, while it is possible to prevent or inhibit the accidental removal of the terminal end from the final stage gear.

The opener (or the final stage gear or the throttle body) may have a wall portion disposed on a spring fitting side of the engaging recess. The wall portion has an opening that permits the radially bent terminal end of the relief spring (or the back spring) to pass through in an axial direction of the coil portion.

With this arrangement, the radially bent terminal end can be easily inserted into the engaging recess. Therefore, the mounting operation of the terminal end of the relief spring (or the back spring) can be further facilitated.

The opener (or the back spring) may have a spring seat portion for supporting an end coil part of the relief spring (or the back spring) on the side of the radially bent terminal end. The spring seat portion has a first surface opposed to the end coil part and a second surface opposite to the first surface. The engaging recess can engage the terminal end such that the radially bent terminal end does not extend beyond the second surface of the spring seat portion.

With this arrangement, it is possible to avoid the potential interference of the terminal end with the other parts of the throttle device.

In another embodiment, at least one of the final stage gear and the opener has a spring support portion with an engaging recess. The spring support portion serves to support one of the opposite end coil parts of the corresponding one of the relief spring and the back spring. The terminal end of the one of the opposite end coil parts is bent in a radial direction with respect to an axis of the corresponding coil portion. The engaging recess is configured to permit insertion of the radially bent terminal end and to permit movement of the radially bent terminal end relative to the engaging recess in a circumferential direction with respect to an axis of the coil portion of the corresponding one of the relief spring and the back spring. The engaging recess is engageable with the radially bent terminal end as the radially bent terminal end moves in the circumferential direction relative to the engaging recess.

The spring support portion may include a first wall portion that defines one of circumferential edges of the engaging recess. The first wall portion has a length in the axial direction.

The spring support portion may further includes a second wall portion and a third wall portion. The second wall portion defines the other of the circumferential edges of the engaging recess and has a length in the axial direction.

The third wall portion extends between the first wall portion and the second wall portion in the circumferential direction and defines a radially inner or outer edge of the engaging recess. The third wall portion opposes to a part of the radially bent terminal end in the axial direction when the radially bent terminal end is in engagement with the engaging recess.

The third wall portion may include an opening that is open in the axial direction to permit the radially bent terminal end to move therethrough in the axial direction.

First Embodiment

A first embodiment of a throttle device according to the present invention will now be described with reference to FIGS. 1 to 6. The basic construction of the throttle device is substantially the same as a throttle device disclosed in Japanese Laid-Open Patent Publication No. 2001-302978, the contents of which are incorporated herein by reference. However, the basic construction of the throttle device will be described in brief. Referring to FIG. 1, a throttle body 10 has a cylindrical intake air channel 11 defined therein. The intake air channel 11 is in communication with an intake system of an internal combustion engine (not shown). A throttle shaft 13 extends across the intake air channel 11 and has opposite end portions that are rotatably supported by the throttle body 10 via bearing 14 and 15, respectively. A disk-shaped throttle valve 16 is mounted to the throttle shaft 13 for opening and closing the intake air channel 11. Thus, as the throttle valve 16 rotates, the intake air channel 11 is opened or closed, so that the amount of flow, i.e. the flow rate, of the intake air to be supplied to the engine can be controlled.

A gear housing portion 18 is formed on one side (right side as viewed in FIG. 1) of the throttle body 10 and defines an inner space that is open at one end (right end as viewed in FIG. 1). A gear cover 20 is attached to the open end face of the gear housing portion 18. One end portion (right end portion as viewed in FIG. 1) of the throttle shaft 13 extends through a boss portion 21 formed on the throttle body 10 and into the inner space of the gear housing portion 18. A throttle gear 13 configured as a sector gear is fixedly mounted to the one end of the throttle shaft 13 within the inner space of the gear housing portion 18. A pair of permanent magnets 24 are attached to the inner circumferential surface of the throttle gear 23. The magnets 24 are opposed to each other in a diametrical direction.

A motor receiving space 26 is defined within a portion (a lower portion as viewed in FIG. 1) of the throttle body 10 and is open into inside of the gear cover 20. A motor 28, such as a DC motor, is disposed within the motor receiving space 26. A drive gear 29 is secured to an output shaft (not shown) of the motor 28. The motor 28 serves as an electrically-driven actuator in this embodiment.

A countershaft 31 extends between the throttle body 10 and the gear cover 20. A counter gear 32 is rotatably supported on the countershaft 31. The counter gear 32 includes a large-diameter gear portion 32*a* and a small-diameter gear portion 32*b*. The large-diameter gear portion 32*a* is in engagement with the drive gear 29. The small-diameter gear portion 32*b* is in engagement with the throttle gear 23.

An electronic control unit (ECU) (not shown) can control the motor 28 based on signals representing various operating conditions of the engine. Such signals may include a signal representing a stepping amount of an accelerator pedal (not shown) and a signal from a rotational angle sensor 42 that will be described later. The drive force or the rotation of the motor 28 is transmitted to the throttle shaft 13 via the drive gear 29, the counter gear 32 and the throttle gear 23, so that the throttle shaft 13 rotates to open or close the intake air channel 11. The throttle gear 23, the drive gear 29 and the counter gear 32 constitute a gear transmission mechanism, in particular a reduction gear mechanism. The throttle gear 23 serves as a final stage gear of the reduction gear mechanism.

An opener 34 is rotatably supported on the throttle shaft 13 and is positioned between the boss portion 21 and the throttle gear 23. A relief spring 36 is interleaved between the throttle gear 23 and the opener 34. The relief spring 36 is a torsion coil spring and is fitted about the throttle shaft 13. A first terminal end of the relief spring 36 is mounted or hooked to the throttle gear 23. A second terminal end opposite to the first terminal end of the relief spring 36 is mounted or hooked to the opener 34 and is labeled with reference numeral 36*a* in FIG. 2. The relief spring 36 serves to resiliently keep engagement between an engaging portion (not shown) of the throttle gear 23 and a corresponding engaging portion (not shown) of the opener 34. The details of the mounting structure (hooking structure) of the second terminal end 36*a* of the relief spring 36 to the opener 34 will be described later. Although not shown in the drawings, the mounting structure of the first terminal end of the relief spring 36 to the throttle gear 36 may be of any suitable structure. For example, the mounting structure may include a pin-like projection formed on the throttle gear 23 and a hook formed on the first terminal end of the relief spring 36 for engagement with the projection.

A back spring 38 is interleaved between the throttle body 10 and the opener 34. The back spring 38 is a torsion coil spring that has a diameter larger than a diameter of the torsion coil spring that constitutes the relief spring 36. The back spring 38 is fitted about the throttle shaft 13. A first terminal end of the back spring 38 is mounted or hooked to the throttle body 10. A second terminal end opposite to the first terminal end of the back spring 38 is mounted or hooked to the opener 34. The back spring 38 serves to normally bias the opener 34 in a closing direction. Although not shown in the drawings, the mounting structure of the first terminal end of the back spring 38 to the throttle body 10 and the mounting structure of the second terminal end of the back spring 38 to the opener 34 may be any suitable structures. For example, pin-like projections may be formed on the throttle body 10 and the opener 34, respectively. Hooks may be formed on the first and second terminal ends of the back spring 38 for engagement with the respective projections.

A stopper 40 for setting the opener opening angle is disposed within the gear housing portion 18 of the throttle body 10. As the opener 34 rotates from the open position toward the close position, a projection (not show) of the opener 34 may contact the stopper 40, so that the opener 34 is prevented from rotation to such an open angle that is smaller than an opener open angle. Thus, the opener open angle is used to mean an open angle of the opener 34, which can be set depending on the position of the stopper 40. The opener open angle is larger than the open angle of the throttle valve 16 at a fully closed position of the throttle valve 16.

The rotational angle sensor 42 is disposed inside of the gear cover 20. The rotational angle sensor 42 is inserted into the throttle gear 23 such that the throttle gear 23 can rotate relative to the rotational angle sensor 42. The rotational angle sensor 42 has a magnetoresistive element (not shown). The magnetoresistive element can detect the rotational angle of the throttle gear 23 based on the position of the magnetoresistive element relative to the permanent magnets 24 and can output a detection signal that is to be supplied to the ECU.

With this arrangement, within a first open angle region where the open angle of the throttle valve 16 is lager than the opener open angle, the throttle gear 23 and the opener 34 rotate together against the biasing force of the back spring 38, while the throttle gear 23 and the opener 34 are kept in engagement with each other by the biasing force of the relief spring 36. Within a second open angle region where the open angle of the throttle valve 16 is smaller than the opener open angle, the throttle gear 23 rotates against the biasing force of the relief spring 36, because, due to contact of the opener 34 with the stopper 40, the opener 34 cannot rotate to such an open angle that is smaller than the opener open angle. When no power is supplied to the motor 28, the throttle gear 23 and the opener 34 are kept in engagement with each other by the biasing force of the relief spring 36, while the opener 34 is biased in the closing direction by the back spring 38. However, the stopper 40 prevents the opener 34 from rotating to such an open angle smaller than the opener open angle. Therefore, the throttle valve 16 is held at the opener open angle. In this way, the throttle gear 23, the opener 34, the relief spring 36, the back spring 38 and the stopper 40 constitute an opener open angle setting mechanism.

The mounting structure of second terminal end 36 of the relief spring 36 to the opener 34 will now be described in detail with reference to FIGS. 2 to 6. For the purpose of explanation of the opener open angle setting mechanism, the side of the throttle valve 16 will be called "front side", and the side of the throttle gear 23 will be called "rear side."

Figure 3:
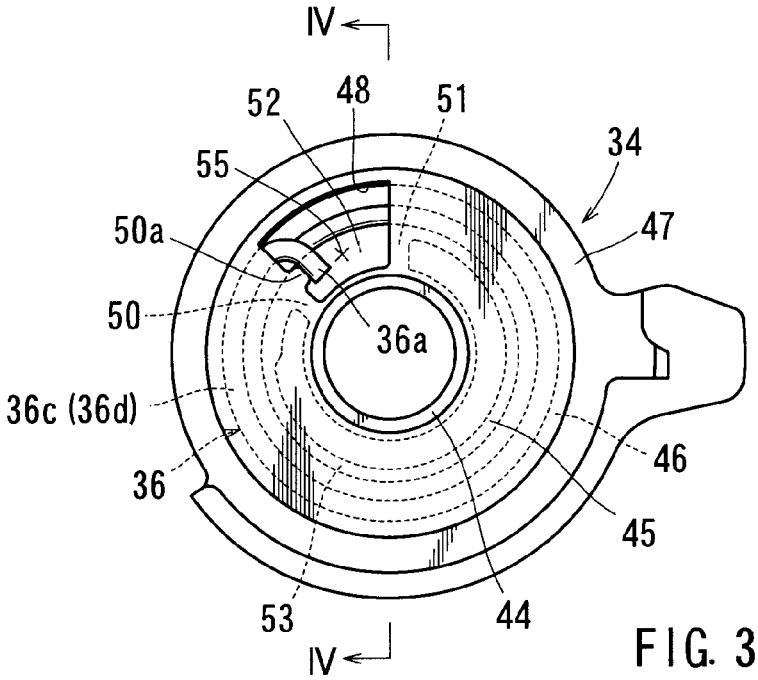
FIG. 3 is a front view of an opener of the throttle device and showing the relation between the opener and a relief spring.

Referring to FIG. 3, the second terminal end 36*a*, i.e., the terminal end on the side of the opener 34 (the front side), of the relief spring 36 is bent in a direction radially inward of a coil portion 36*c* of the relief spring 36.

Figure 4:
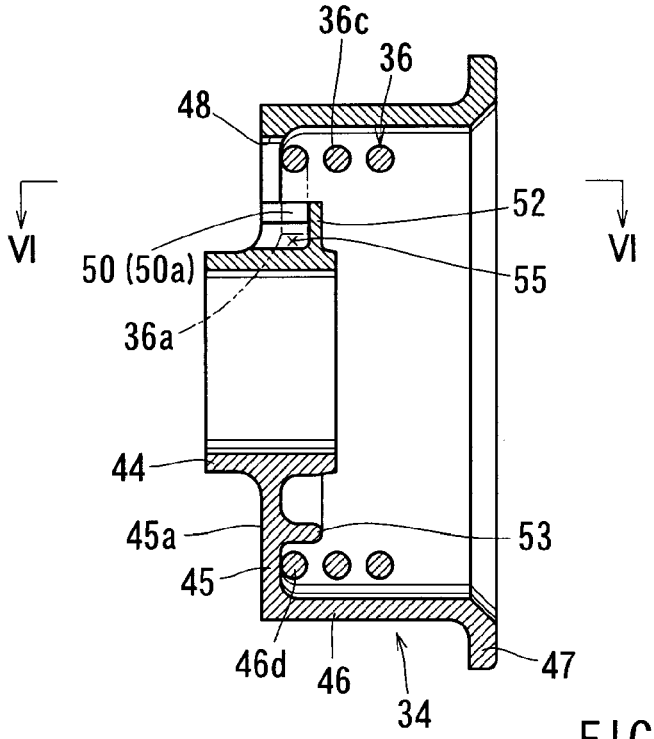
FIG. 4 is a cross sectional view taken along line IV-IV in FIG. 3.
Figure 5:
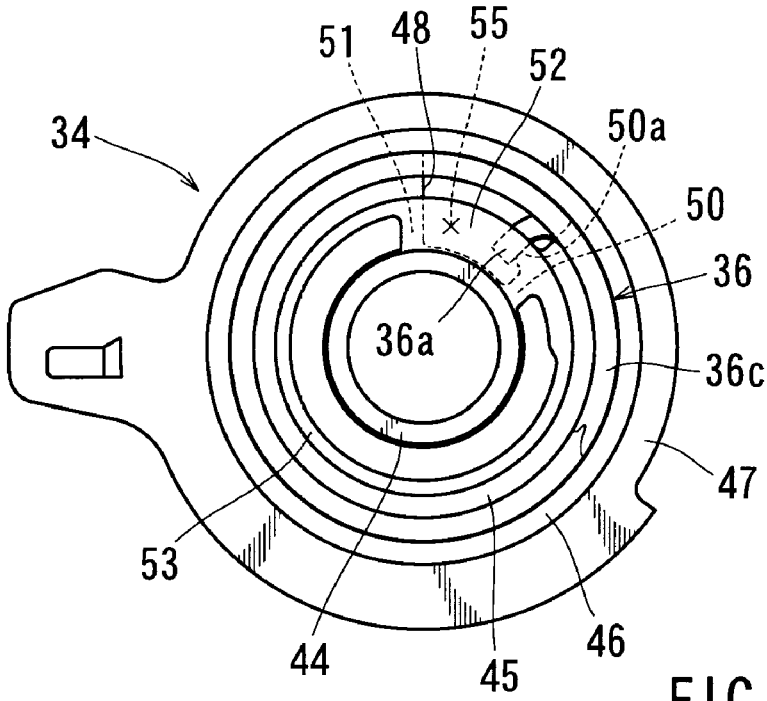
FIG. 5 is a rear view of the opener.

As shown in FIG. 4, the opener 34 has a boss portion 44, a front spring seat portion 45, a spring guide portion 46 and a rear spring seat portion 47. The boss portion 44 has a cylindrical tubular configuration and is rotatably fitted onto the throttle shaft 13 (see FIG. 2). The front spring seat portion 45 has an annular plate-like configuration and is formed on the central portion with respect to the axial direction of the outer circumferential surface of the boss portion 44. The front spring seat portion 45 is in contact with an end coil part 36*d* of the relief spring 36. The end coil part 36*d* is positioned on the side of the opener 34 of the relief spring 36 (see FIG. 4).

The spring guide portion 46 has a cylindrical tubular configuration and extends rearward from the outer peripheral edge of the front spring seat portion 45. The spring guide portion 46 serves to guide the relief spring 36 and also serves to guide the back spring 38 (see FIG. 2). The rear side spring seat portion 47 has an annular plate-like configuration and extends radially outward from the rear end of the spring guide portion 46. The rear side spring seat portion 47 is in contact with an end coil part 38*d* of the back spring 38. The end coil part 38*d* is positioned on the side of the opener 34.

Figure 6:
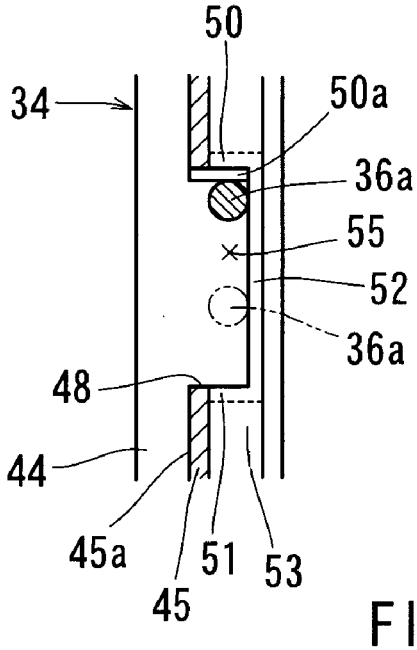
FIG. 6 is a cross sectional view taken along line VI-VI in FIG. 4.
Figure 7:
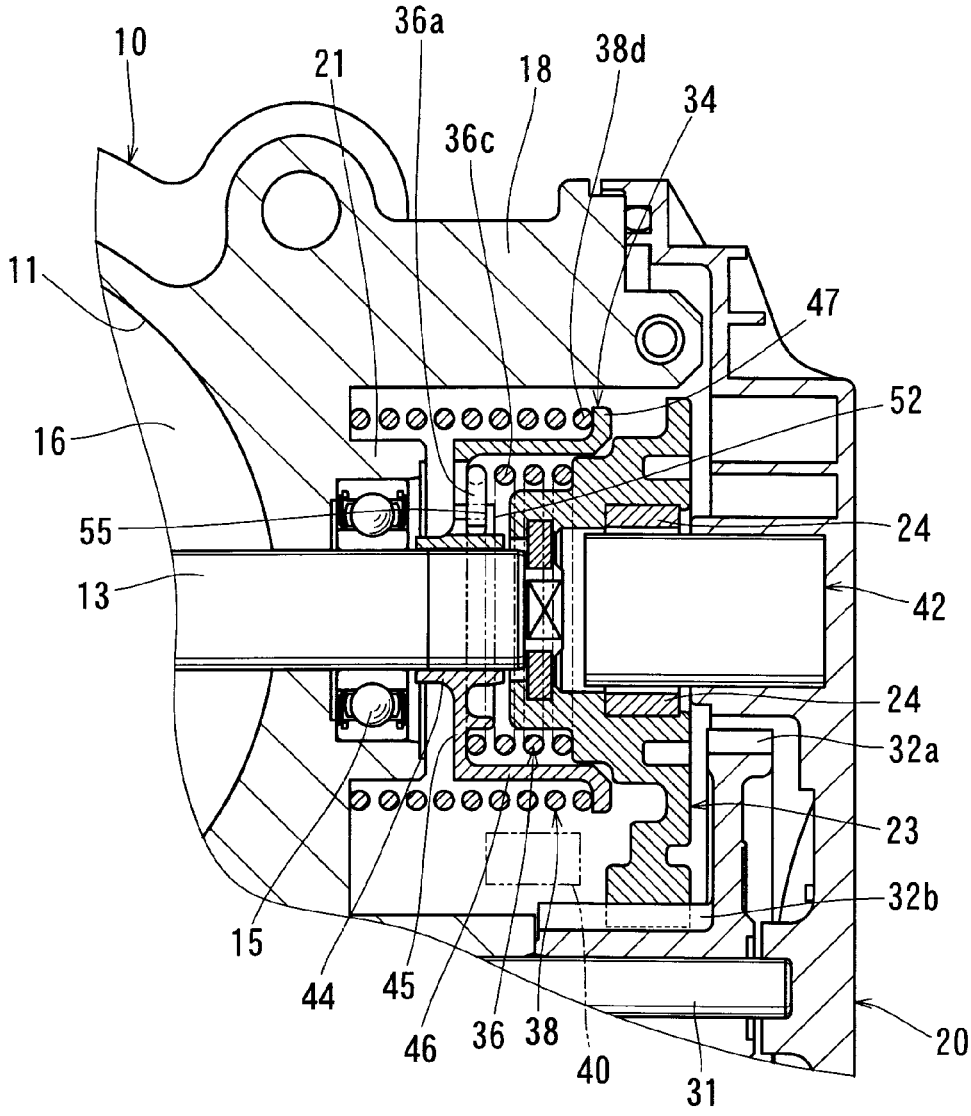
FIG. 7 is an enlarged view similar to FIG. 2 but showing a second embodiment of the present invention.
Figure 8:
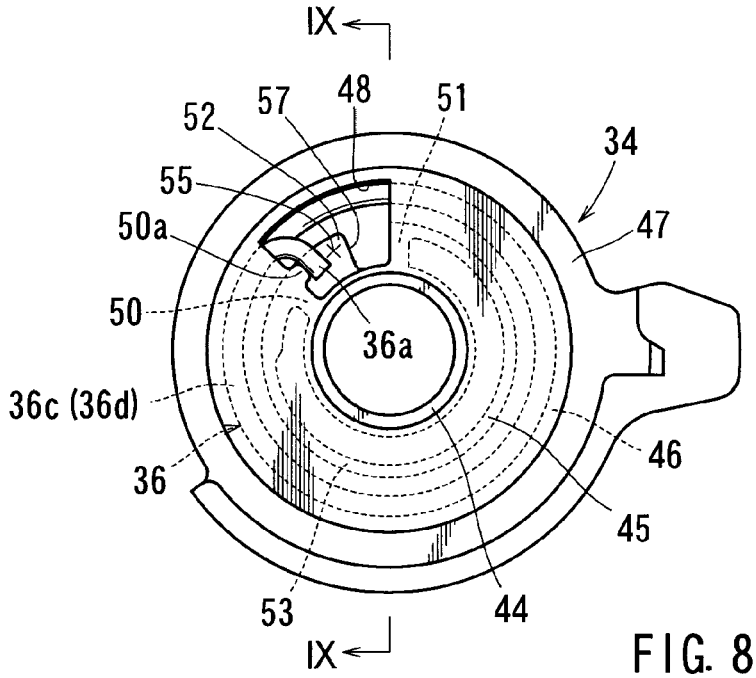
FIG. 8 is a front view of an opener shown in FIG. 7.
Figure 9:
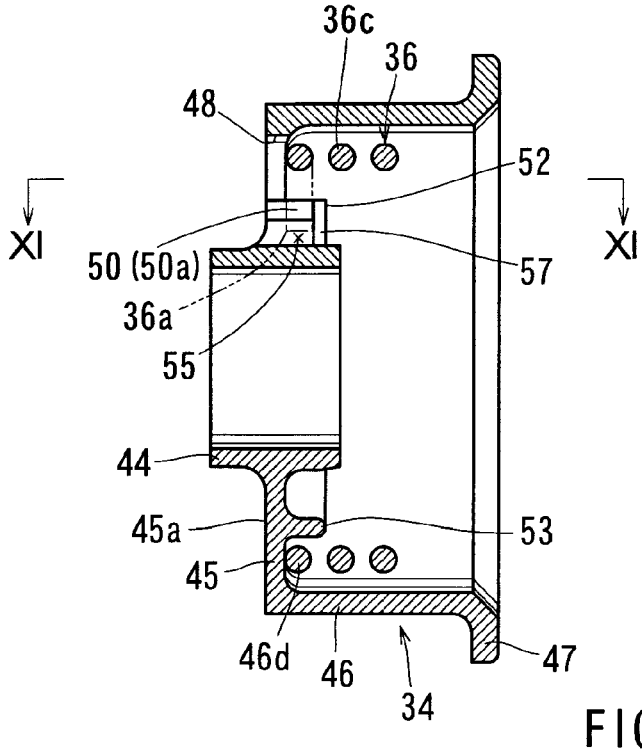
FIG. 9 is a cross sectional view taken along line IX-IX in FIG. 8.
Figure 10:
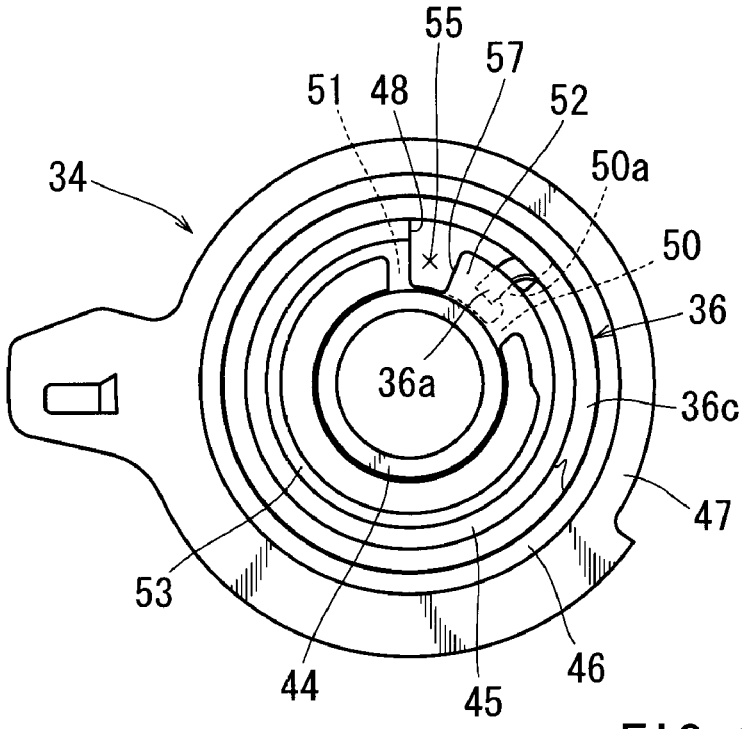
FIG. 10 is a rear view of the opener.

As shown in FIG. 3, a window 48 having a substantially sectorial configuration is formed in the front spring seat portion 45 over the angular range of about 45°. As shown in FIG. 6, a pair of plate-like wall portions 50 and 51 extend rearward from opposite edges in the circumferential direction of the window 48 of the front spring seat 45 and each extends radially outward from the outer circumferential surface of the boss portion 44. A side wall 52 having a sectorial configuration is formed to connect between the rear ends of the wall portions 50 and 51 within a circumferential region corresponding to the window 48 and extends radially outward from the outer circumferential surface of the boss portion 44 (see FIG. 5). As shown in FIG. 4, a C-shaped guide portion 53 is formed to connect between the wall portions 50 and 51 within the remaining circumferential region and to connect between opposite circumferential ends of the side wall 52. The end coil part 36*d* on the side of the opener 34 of the relief spring 36 is fitted between the guide portion 53 and the spring guide portion 46.

An engaging recess 55 is defined by the wall portions 50 and 51 and the side wall 52 and can receive the second terminal end 36*a* of the relief spring 36 such that the second terminal end 36*a* can move in the circumferential direction within a predetermined range, i.e., a range of about 45°. One of the wall portions 50 and 51 positioned on the side of a closing direction (i.e., the wall portion 50 in this embodiment) serves as an engaging wall for engaging the second terminal end 36*a* of the relief spring 36. A linear projection 50*a* is formed on one of the circumferential edges of the window 48 including the corresponding surface of the engaging wall 50 and extends in forward and rearward directions. In this way, the opener 34 serves as a spring mount member, and the side wall 52 defining the engaging recess 55 serves as a spring fitting-side wall portion. The front support seat 45, the wall portions 50 and 51, the side wall 52, the guide portion 53 and the spring guide portion 46 constitute a spring support portion of the spring mount member (i.e., the opener 34 in case of this embodiment).

The operation for mounting the second terminal end 36*a* of the relief spring 36 to the opener 34 will now be described. First, the second terminal end 36*a* of the relief spring 36 is inserted into the engaging recess 55 as indicated by a two-dot chain line in FIG. 6. In this state, the second terminal end 36*a* can move in the circumferential direction along the engaging recess 55. The second terminal end 36*a* can be easily inserted into the engaging recess 55 by the adjustment of the relative position between the opener 34 and the relief spring 36.

Thereafter, the opener 34 and the relief spring 36 are brought to be positioned in alignment each other along the same axis. Subsequently, the opener 34 and the relief spring 36 are rotated relative to each other, so that the second terminal end 36*a* of the relief spring 36 abuts to and engages the engaging wall 50 (more specifically, the linear projection 50*a*) as indicated by a solid line in FIG. 6. At the same time, the end coil part 36*d* of the relief spring 36 is fitted between the guide portion 53 and the spring guide portion 46 and is brought to contact with the spring seat portion 45 (see FIG. 4). The mounting operation of the relief spring 36 to the opener 34 is thus completed.

As described above, according to the mounting structure for mounting the terminal end 36*a* of the relief spring 36 to the opener 34 of this embodiment, the second terminal end 36*a* of the relief spring 36 is first inserted into the engaging recess 55 of the opener 34 and is subsequently engaged by the engaging wall 50 positioned at the circumferential edge of the engaging recess 55. Therefore, it is possible to facilitate the mounting operation of the second terminal end 36*a* of the relief spring 36 to the opener 34 and to prevent or inhibit the second terminal end 36*a* from being removed from the opener 34.

In addition, in the mounted position of the second terminal end 36*a* of the relief spring to the opener 34, the second terminal end 36*a* may not protrude beyond the front surface 45*a* of the spring seat portion 45 that supports the end coil part 36*d* of the relief spring 36 (see FIG. 4). Therefore, it is possible to avoid the potential interference of the second terminal end 36*a* with the other parts of the throttle device, such as the boss portion 21 of the throttle body 10 and the bearing 15 received within the boss portion 21. Hence, the potential removal of the second terminal end 36*a* of the relief spring 36 and the potential deformation of the second terminal end 36*a* due to the interference with the other parts can be reliably prevented.

Further, the terminal end 36*a* is simply bent in the radial direction (more specifically, radially inward) of the coil portion 36*c* to have a substantially L-shape for engaging the opener 34. Therefore, the terminal end 36*a* can be easily formed in comparison with a known arrangement where a terminal end of a relief spring is bent in a turn back manner to form a hook.

Furthermore, because the engaging recess 55 has a configuration elongated in the circumferential direction, it is possible to easily insert the second terminal end 36*a* of the relief spring 36 into the engaging recess 55.

Furthermore, because the second terminal end 36*a* is engaged by the opener 34 at the circumferential edge of the engaging recess 55, it is possible to avoid the application of an unusual force to the relief spring 36.

Furthermore, in conjunction with the formation of the window 48, the wall portions 50 and 51 and the side wall 52 can be easily formed by molding the opener 34 by resin.

Second to fourth embodiments will now be described with reference to FIGS. 7 to 14. These embodiments are modifications of the first embodiment. Therefore, like members are given the same reference numerals as the first embodiment and the description of these members will not be repeated.

Second Embodiment

A second embodiment will now be described with reference to FIGS. 7 to 11. As shown in FIGS. 8 to 11, this embodiment is different from the first embodiment in that the side wall 52 adjacent to the engaging recess 55 of the opener 34 has an opening 57 in a position adjacent to the wall portion 51. The opening 57 allows the second terminal end 36*a* of the relief spring 36 to pass through the side wall 52 in the axial direction of the coil portion 36*c* (i.e., in the forward and rearward directions) as indicated by an arrow "Y" in FIG. 11.

Figure 11:
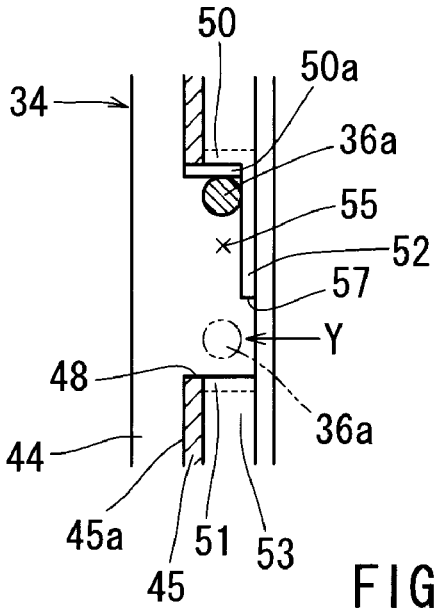
FIG. 11 is a cross sectional view taken along line XI-XI in FIG. 9.

According to this embodiment, the second terminal end 36*a* of the relief spring 36 can be easily inserted into the engaging recess 55 by inserting the second terminal end 36*a* into the opening 57 from the rear side of the opening 57 in the axial direction of the coil portion 36*c* (see the arrow "Y" in FIG. 11). Therefore, it is possible to further facilitate the mounting operation of the second terminal end 36*a* of the relief spring 36 to the opener 34.

Figure 12:
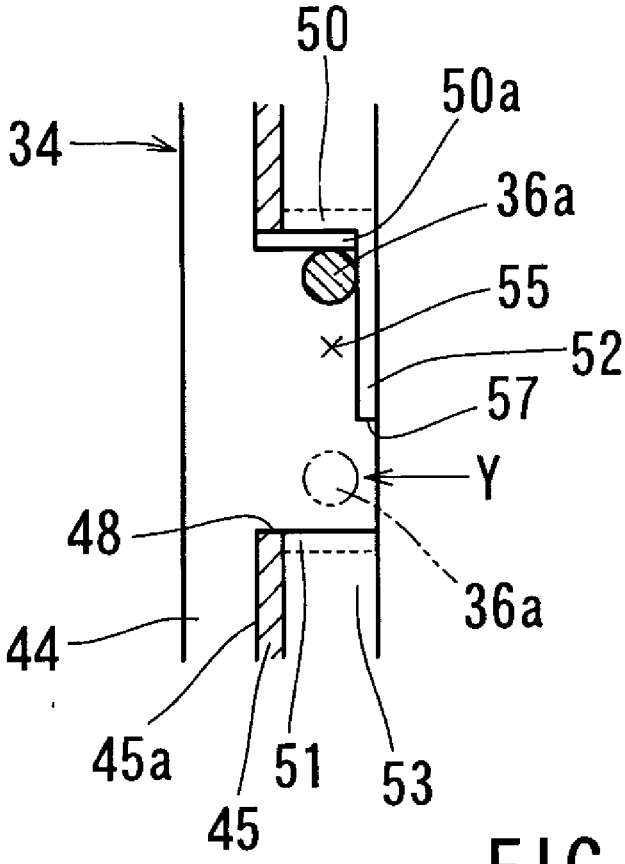
FIG. 12 is a cross sectional view similar to FIG. 11 but showing a modification of the second embodiment.

The second embodiment may be modified as shown in FIG. 12, in which the side wall 52 of the opener 34 is shifted rearward (rightward as viewed in FIG. 12) from the position shown in FIG. 11, so that the side wall 52 is positioned at the rear end of the boss portion 44. In this connection, the length in the forward and rearward directions of each of the wall portions 50 and 51 is extended.

Also with this arrangement, it is possible to engage the second terminal end 36*a* of the relief spring 36 by the opener 34 at the circumferential end of the engaging recess 55 such that the second terminal end 36*a* may not protrude beyond the front surface 45*a* of the spring seat portion 45 that supports the end coil part 36*d* of the relief spring 36.

Third Embodiment

Figure 13:
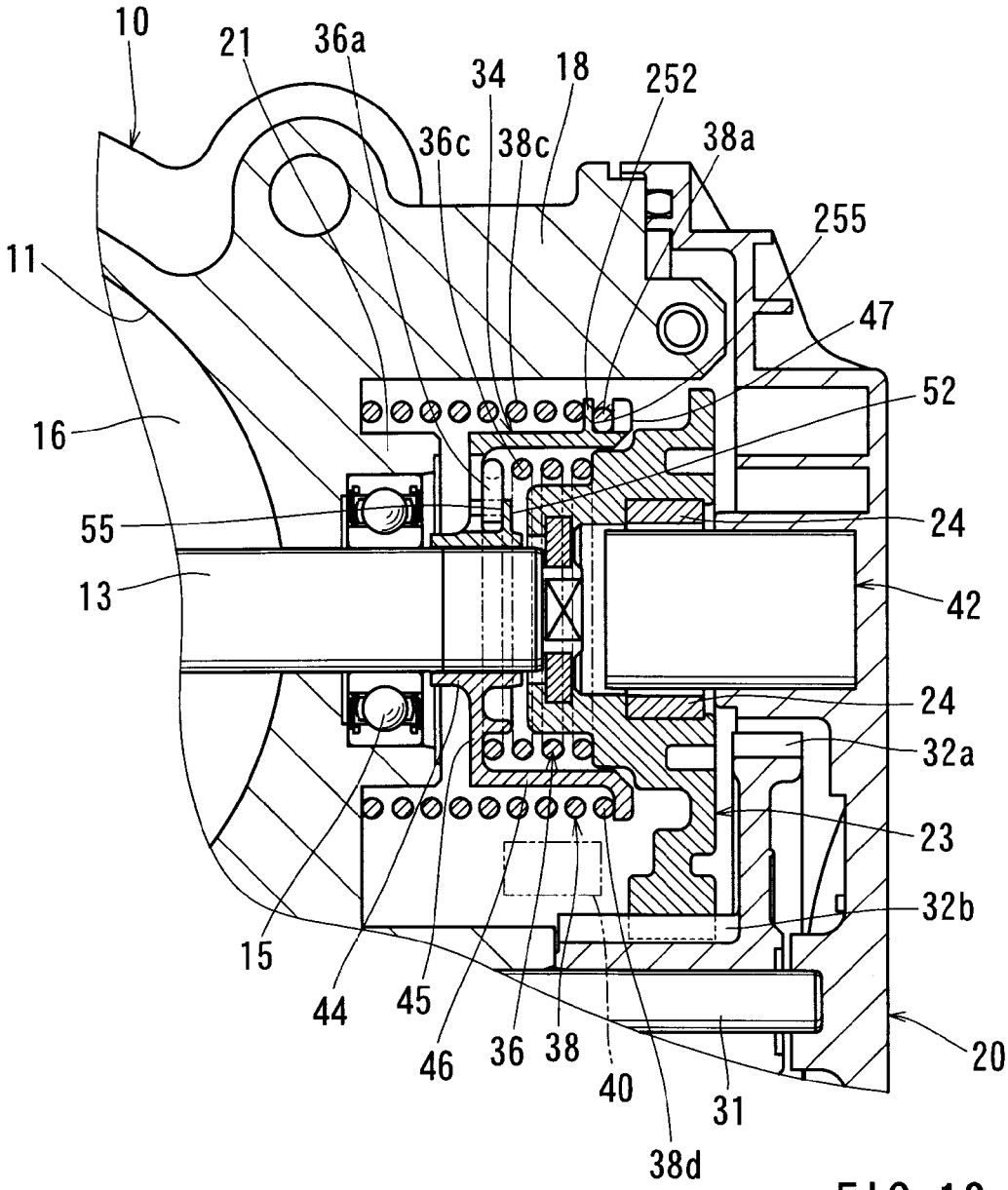
FIG. 13 is an enlarged cross sectional view similar to FIG. 2 but showing a third embodiment of the present invention.

A third embodiment will now be described with reference to FIG. 13. In this embodiment, a mounting structure similar to the mounting structure of the terminal end 36*a* of the relief spring 36 to the opener 34 of the first embodiment is applied to the mounting structure for mounting the second terminal end of the back spring 38 to the opener 34. The second terminal end is labeled with reference numeral 38*a* in FIG. 13 and is positioned on the rear side of the back spring 38. In this embodiment, the second terminal end 38*a* is bent radially inward of a coil portion 38*c* of the back spring 38.

In addition, an engaging recess 255 similar to the engaging recess 55 is formed in the opener 34 in a position between the spring guide portion 46 and the rear spring seat portion 47. A side wall 252 corresponding to the side wall 52 is positioned on the front side (left side as viewed in FIG. 13) of the rear spring seat portion 47. The other construction relating to the engaging recess 255 is the same as the engaging recess 55 of the first embodiment. In this embodiment, the opener 34 serves as a spring mount for mounting the back spring 38.

In order to mount the second terminal end 38*a* of the back spring 38 to the opener 34, the second terminal end 38*a* is first inserted into the engaging recess 255. Then, the opener 34 and the back spring 38 is rotated relative to each other, so that the second terminal end 38*a* is engaged by the opener 34 at one of the circumferential edges of the engaging recess 255. At the same time, the end coil part 38*d* of the back spring 38 is fitted on the guide portion 46 and is brought to contact with the rear spring seat portion 47. The mounting operation of the the back spring 38 to the opener 34 is thus completed.

According to this embodiment, the second terminal end 38*a* of the back spring 38 is inserted into the engaging recess 255 of the opener 34 and is then engaged by the opener 34 at a predetermined position in the circumferential direction. Therefore, it is possible to facilitate the mounting operation of the terminal end 38*a* of the back spring 38 to the opener 34 and to prevent or inhibit the second terminal end 38*a* from being removed.

Fourth Embodiment

Figure 14:
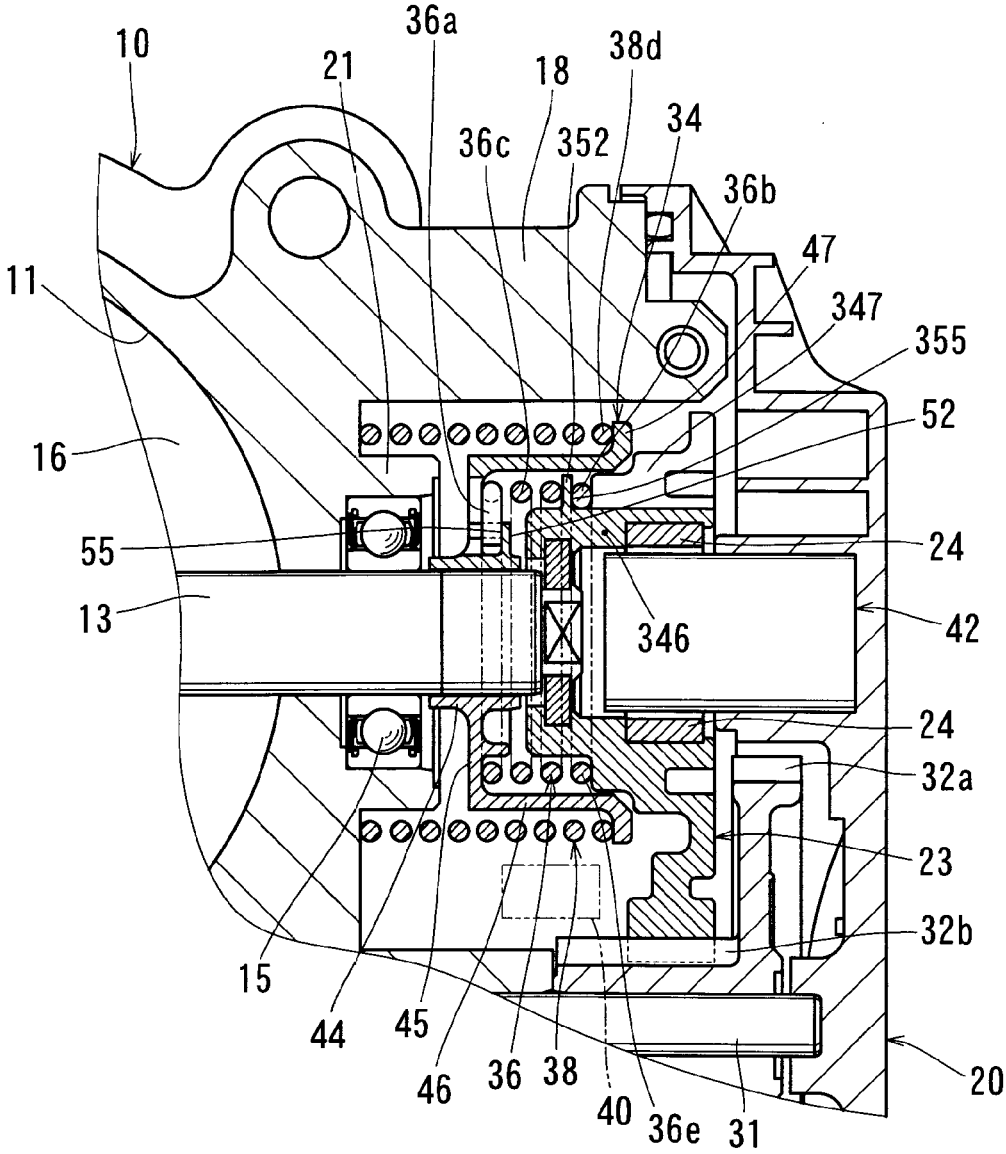
FIG. 14 is an enlarged cross sectional view similar to FIG. 2 but showing a fourth embodiment of the present invention.
Figure 15:
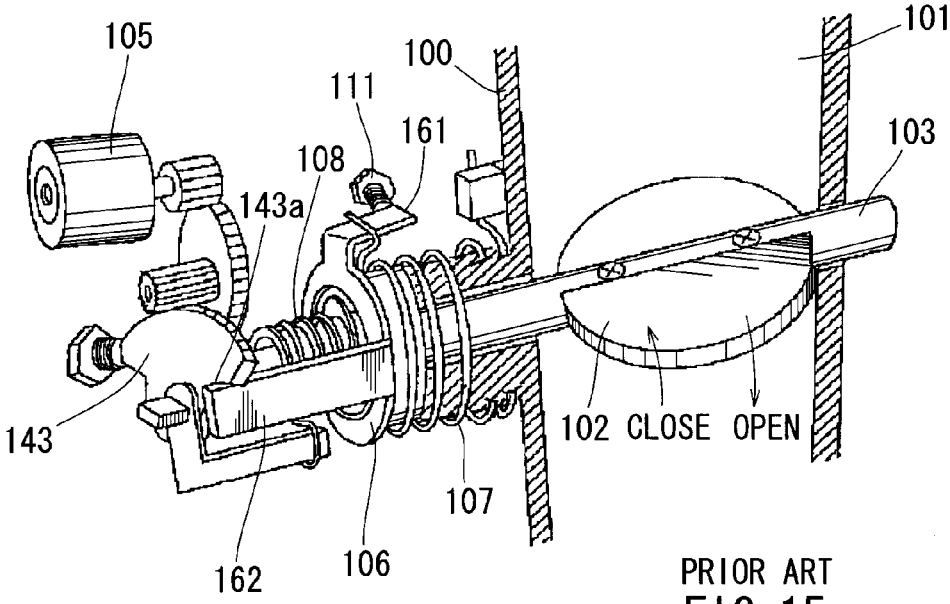
PRIOR ART FIG. 15
FIG. 15 is a schematic perspective view of a known throttle device.
Figure 16:
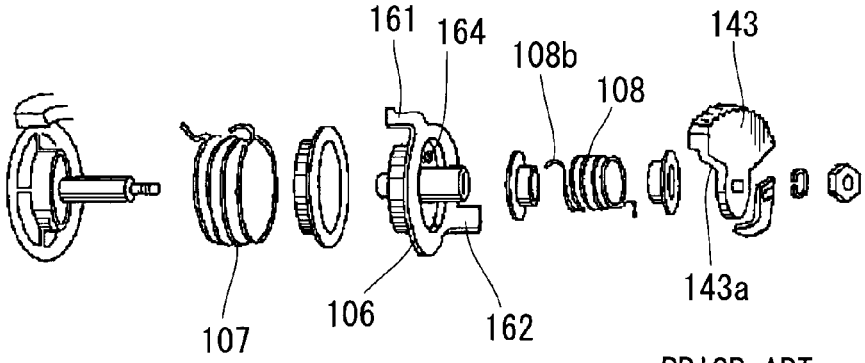
PRIOR ART FIG. 16
FIG. 16 is an exploded perspective view of a default opening angle setting mechanism of the known throttle device.

A fourth embodiment will now be described with reference to FIG. 14. In this embodiment, a mounting structure similar to the mounting structure of the second terminal end 36*a* of the relief spring 36 to the opener 34 of the first embodiment is applied to the mounting structure for mounting the first terminal end of the relief spring 36 to the throttle gear 23. The first terminal end of the relief spring 36 is labeled with reference numeral 36*b* in FIG. 14. The first terminal end 36*b* of the relief spring 36 is positioned on the rear side (i.e., the side of the throttle gear 23) of the relief spring 36. In this embodiment, the first terminal end 36*b* is bent radially inward of the coil portion 36*c*.

In addition, an engaging recess 355 similar to the engaging recess 55 or the engaging recess 255 of the second embodiment is formed in the throttle gear 23 in a position between a spring guide portion 346 and a spring seat portion 347. A side wall 352 corresponding to the side wall 52 or 252 is positioned on the front side (left side as viewed in FIG. 14) of the spring seat portion 347. The other construction relating to the engaging recess 355 is the same as the engaging recess 55 of the first embodiment. In this embodiment, the throttle gear 23 serves as a spring mount for mounting the relief spring 36.

In order to mount the first terminal end 36*b* of the relief spring 36 to the throttle gear 23, the first terminal end 36*b* is first inserted into the engaging recess 355. Then, the throttle gear 23 and the relief spring 36 are rotated relative to each other, so that the first terminal end 36*b* is engaged by the throttle gear 23 at one of the circumferential edges of the engaging recess 355. At the same time, an end coil part 36*e* on the side of the first terminal end 36*b* is fitted on the guide portion 346 and is brought to contact with the spring seat portion 347. The mounting operation of the relief spring 36 to the throttle gear 23 is thus completed.

According to this embodiment, the first terminal end 36*b* of the relief spring 36 is inserted into the engaging recess 355 of the throttle gear 23 and is then engaged by the throttle gear 23 at a predetermined position in the circumferential direction. Therefore, it is possible to facilitate the mounting operation of the first terminal end 36*b* of the relief spring 36 to the throttle gear 23 and to prevent or inhibit the first terminal end 36*b* from being removed.

The present invention may not be limited to the above embodiment but may be modified in various ways. For example, although the terminal end of the spring (the relief spring or the back spring) is bent radially inward of the coil portion in each of the above embodiments, it is possible to bend the terminal end radially outward of the coil portion and to configure the engaging recess of the corresponding spring mount (the opener or the throttle gear) such that the terminal end can be inserted into the engaging recess and can be engaged by the spring mount at a predetermined position in the circumferential direction.

This invention claims:

1. A throttle device for an internal combustion engine, comprising:

a throttle body defining therein an intake air channel;

a throttle valve having a throttle shaft and disposed within the intake air channel;

an electrically-driven actuator operable to rotate the throttle shaft for opening and closing the throttle valve;

a gear transmission mechanism constructed to transmit a drive force of the actuator to the throttle shaft and including a final stage gear fixedly mounted to the throttle shaft;

an opener rotatably mounted to the throttle shaft;

a back spring comprising a torsion coil spring and interleaved between the throttle body and the opener, so that the opener is biased in a closing direction of the throttle valve by the back spring;

an opener open angle setting stopper disposed on the throttle body and constructed to prevent the opener from rotating to such an open angle that is smaller than an opener open angle, the opener open angle being larger than the open angle of the throttle valve at a fully closed position of the throttle valve;

a relief spring comprising a torsion coil spring and interleaved between the final stage gear and the opener, so that (a) the final stage gear and the opener engage with each other and rotate together when the open angle of the throttle valve is equal to or larger than the opener open angle, and (b) the final stage gear can rotate in a direction for disengagement with the opener when the open angle of the throttle valve is smaller than the opener open angle;

wherein the throttle valve is held at the opener open angle when no power is supplied to the actuator;

wherein the relief spring has a terminal end on the side of the opener, the terminal end being bent radialy outward or inward of a coil portion of the relief spring;

wherein the opener has an engaging recess that can receive the terminal end of the relief spring, wherein the engaging recess is configured to permit movement of the terminal end in a circumferential direction of the opener and to be able to engage the terminal end at a predetermined position with respect to the circumferential direction.

2. The throttle device as in claim 1, wherein:

the opener has an wall portion disposed on a spring fitting side of the engaging recess;

the wall portion has an opening that permits the terminal end of the relief spring to pass through in an axial direction of the coil portion.

3. The throttle device as in claim 2, wherein:

the opener has a spring seat portion for supporting an end coil part of the relief spring on the side of the terminal end;

the spring seat portion has a first surface opposed to the end coil part and a second surface opposite to the first surface; and the engaging recess can engage the terminal end of the relief spring such that the terminal end does not extend beyond the second surface of the spring seat portion.

4. A throttle device for an internal combustion engine, comprising:

a throttle body defining therein an intake air channel;

a throttle valve having a throttle shaft and disposed within the intake air channel;

an electrically-driven actuator operable to rotate the throttle shaft for opening and closing the throttle valve;

a gear transmission mechanism constructed to transmit a drive force of the actuator to the throttle shaft and including a final stage gear fixedly mounted to the throttle shaft;

an opener rotatably mounted to the throttle shaft;

a back spring comprising a torsion coil spring and interleaved between the throttle body and the opener, so that the opener is biased in a closing direction of the throttle valve by the back spring;

an opener open angle setting stopper disposed on the throttle body and constructed to prevent the opener from rotating to such an open angle that is smaller than an opener open angle, the opener open angle being larger than the open angle of the throttle valve at a fully closed position of the throttle valve;

a relief spring comprising a torsion coil spring and interleaved between the final stage gear and the opener, so that (a) the final stage gear and the opener engage with each other and rotate together when the open angle of the throttle valve is equal to or larger than the opener open angle, and (b) the final stage gear can rotate in a direction for disengagement with the opener when the open angle of the throttle valve is smaller than the opener open angle;

wherein the throttle valve is held at the opener open angle when no power is supplied to the actuator;

wherein the back spring has a terminal end on the side of the opener, the terminal end being bent radialy outward or inward of a coil portion of the back spring;

wherein the opener has an engaging recess that can receive the terminal end of the back spring, wherein the engaging recess is configured to permit movement of the terminal end in a circumferential direction of the opener and to be able to engage the terminal end at a predetermined position with respect to the circumferential direction.

5. The throttle device as in claim 4, wherein:

the opener has an wall portion disposed on a spring fitting side of the engaging recess;

the wall portion has an opening that permits the terminal end of the back spring to pass through in an axial direction of the coil portion.

6. The throttle device as in claim 5, wherein:

the opener has a spring seat portion for supporting an end coil part of the back spring on the side of the terminal end;

the spring seat portion has a first surface opposed to the end coil part and a second surface opposite to the first surface; and the engaging recess can engage the terminal end of the back spring such that the terminal end does not extend beyond the second surface of the spring seat portion.

7. A throttle device for an internal combustion engine, comprising:

a throttle body defining therein an intake air channel;

a throttle valve having a throttle shaft and disposed within the intake air channel;

an electrically-driven actuator operable to rotate the throttle shaft for opening and closing the throttle valve;

a gear transmission mechanism constructed to transmit a drive force of the actuator to the throttle shaft and including a final stage gear fixedly mounted to the throttle shaft;

an opener rotatably mounted to the throttle shaft;

a back spring comprising a torsion coil spring and interleaved between the throttle body and the opener, so that the opener is biased in a closing direction of the throttle valve by the back spring;

an opener open angle setting stopper disposed on the throttle body and constructed to prevent the opener from rotating to such an open angle that is smaller than an opener open angle, the opener open angle being larger than the open angle of the throttle valve set at a fully closed position of the throttle valve;

a relief spring comprising a torsion coil spring and interleaved between the final stage gear and the opener, so that (a) the final stage gear and the opener engage with each other and rotate together when the open angle of the throttle valve is equal to or larger than the opener open angle, and (b) the final stage gear can rotate in a direction for disengagement with the opener when the open angle of the throttle valve is smaller than the opener open angle;

wherein the throttle valve is held at the opener open angle when no power is supplied to the actuator;

wherein the relief spring has a terminal end on the side of the final stage gear, the terminal end being bent radialy outward or inward of a coil portion of the relief spring;

wherein the final stage gear has an engaging recess that can receive the terminal end of the relief spring, wherein the engaging recess is configured to permit movement of the terminal end in a circumferential direction of the final stage gear and to be able to engage the terminal end at a predetermined position with respect to the circumferential direction.

8. The throttle device as in claim 7, wherein:

the final stage gear has an wall portion disposed on a spring fitting side of the engaging recess;

the wall portion has an opening that permits the terminal end of the relief spring to pass through in an axial direction of the coil portion.

9. The throttle device as in claim 8, wherein:

the final stage gear has a spring seat portion for supporting an end coil part of the relief spring on the side of the terminal end;

the spring seat portion has a first surface opposed to the end coil part and a second surface opposite to the first surface; and the engaging recess can engage the terminal end such that the terminal end does not extend beyond the second surface of the spring seat portion.

10. A throttle device for an internal combustion engine, comprising:

a throttle body defining therein an intake air channel;

a throttle valve having a throttle shaft and disposed within the intake air channel;

an electrically-driven actuator operable to rotate the throttle shaft for opening and closing the throttle valve;

a gear transmission mechanism constructed to transmit a drive force of the actuator to the throttle shaft and including a final stage gear fixedly mounted to the throttle shaft;

an opener rotatably mounted to the throttle shaft;

a relief spring comprising a torsion coil spring interleaved between the throttle body and the opener and having a coil portion and opposite end coil parts with respective terminal ends; and a back spring comprising a torsion coil spring interleaved between the final stage gear and the opener and having a coil portion and opposite end coil parts with respective terminal ends, wherein:

at least one of the final stage gear and the opener has a spring support portion with an engaging recess, the spring support portion supporting one of the opposite end coil parts of the corresponding one of the relief spring and the back spring;

the terminal end of the one of the opposite end coil parts is bent in a radial direction with respect to an axis of the corresponding coil portion;

the engaging recess is configured to permit insertion of the radially bent terminal end and to permit movement of the radially bent terminal end relative to the engaging recess in a circumferential direction with respect to an axis of the corresponding coil portion; and the engaging recess is engageable with the radially bent terminal end as the radially bent terminal end moves in the circumferential direction relative to the engaging recess.

11. The throttle device as in claim 10, wherein:

the spring support portion includes a first wall portion defining one of circumferential edges of the engaging recess and having a length in the axial direction.

12. The throttle device as in claim 11, wherein the spring support portion further includes:

a second wall portion defining the other of the circumferential edges of the engaging recess and having a length in the axial direction;

a third wall portion extending between the first wall portion and the second wall portion in the circumferential direction and defining an edge in the radial direction of the engaging recess.

13. The throttle device as in claim 12, wherein the third wall portion opposes to a part of the radially bent terminal end in the axial direction when the radially bent terminal end is in engagement with the engaging recess.

14. The throttle device as in claim 12, wherein the third wall portion includes an opening that is open in the axial direction to permit the radially bent terminal end to move therethrough in the axial direction.

15. The throttle device as in claim 10, wherein the relief spring has the radially bent terminal end, and the opener has the spring support portion.

16. The throttle device as in claim 10, wherein the back spring has the radially bent terminal end, and the opener has the spring support portion.

17. The throttle device as in claim 10, wherein the relief spring has the radially bent terminal end, and the final stage gear has the spring support portion.

* * * * *